United States Patent [19]

Wiggins

[11] 4,313,475

[45] Feb. 2, 1982

[54] VOLTAGE BLOCK SYSTEM FOR ELECTROSTATIC COATING WITH CONDUCTIVE MATERIALS

[75] Inventor: Richard F. Wiggins, Fairfield, Conn.

[73] Assignee: The Gyromat Corporation, Bridgeport, Conn.

[21] Appl. No.: 163,158

[22] Filed: Jun. 26, 1980

[51] Int. Cl.[3] ..... B65B 3/04

[52] U.S. Cl. ..... 141/18; 118/506

[58] Field of Search ..... 141/1, 2, 18–29, 141/94–96, 192, 198; 118/506

[56] References Cited

U.S. PATENT DOCUMENTS 4,144,913 3/1979 Akers et al. ..... 141/18

*Primary Examiner*—Houston S. Bell, Jr.

*Attorney, Agent, or Firm*—Mandeville & Schweitzer

[57] ABSTRACT

The disclosure relates to a voltage block system for delivering conductive coating materials continuously to electrically charged electrostatic paint spray devices from a primary paint supply system which is at ground potential. In a preferred form, the system utilizes cooperatively associated coating material transfer and inventory vessels. The inventory vessel is connected to the electrostatically charged spray devices and continuously supplies coating material thereto. The transfer vessel is alternatively coupled to the primary paint supply, in order to be replenished thereby, and with the inventory tank, in order to refill the inventory tank prior to its exhaustion. The inventory tank is maintained under a positive gas pressure both during refilling operations and at other times, so that coating material is always supplied to the spray devices under pressure. At all times, the primary paint supply is isolated from the high voltage. In a simplified, special purpose version, a single inventory tank is refilled during intervals between the arrival of successive workpieces on a continuously moving conveyor. In this version, the high voltage is turned off during refilling operations. The system lends itself well to production lines, where there is frequent need for changing from one color of coating material to another.

11 Claims, 8 Drawing Figures

VOLTAGE BLOCK SYSTEM FOR ELECTROSTATIC COATING WITH CONDUCTIVE MATERIALS

BACKGROUND AND SUMMARY OF THE INVENTION

The present invention is directed to electrostatic coating, and more particularly to improved systems for the application of conductive coating materials by electrostatic techniques.

Electrostatic paint spraying techniques are, in general, well known and involve the discharge of coating material in atomized form, with the atomized particles carrying an electrostatic charge and with the workpiece being electrically charged to an opposite polarity in order to establish an electrostatic attraction for the charged atomized particles. Typically, the paint atomizing equipment is charged to a high voltage relative to the workpiece, with voltages in excess of 100,000 volts being common. Accordingly, it is necessary to carefully isolate the electrically charged components, not only for safety purposes, but also to prevent the charge from being drained off to ground. This can present a considerable problem when the coating material is of a conductive nature, particularly where the coating material uses water as a solvent, for example, or where the coating material, even though utilizing a nonconductive solvent, incorporates a conductive pigment material, such as with metallic coatings.

One of the known procedures for electrically isolating conductive coating materials is to contain the coating material within a pressurized, electrically isolated container, which is connected to the atomizing device. This arrangement, while satisfactory for batch operations, does not lend itself to the operation of continuous painting lines, nor does it accommodate expeditious color change where items being conveyed along a paint line conveyor, for example, are selectively painted with different colors according to production requirements.

In accordance with the present invention, a novel and highly simplified system is provided which permits the utilization of condutive coating materials and which accommodates the continuous operation of the paint line. The system includes a voltage block arrangement which, in effect, temporarily isolates from the system a container of electrically charged, conductive coating material, yet which permits the container to be periodically replenished, as necessary, in order to maintain continuous operation of the paint line but at the same time maintaining electrical isolation of the highly charged paint vessel from the primary paint supply. The system of the invention enables the primary supply to be in the form of a recirculating system, such that the primary paint materials are continuously being circulated back to a paint room and mixing area, to avoid stagnation and sedimentation of the paint. Moreover, the system of the invention easily accommodates rapid color changes.

In one advantageous form of the invention, the voltage block system includes a pair of associated tanks or vessels for the coating material. One of the vessels, referred to as an inventory tank, maintains a supply of coating material constantly under pressure and continuously being supplied to the atomizing devices. The second tank, referred to herein as a transfer tank, is alternatively connectable to the inventory tank or to the primary paint supply. During a painting operation, the transfer tank is temporarily connected to the main paint supply and filled with a predetermined batch of coating material. When the inventory tank becomes depleted, the transfer tank is connected to the inventory tank, while being isolated from the main supply, and coating material is caused to be delivered from the transfer tank into the inventory tank in order to maintain continuity of supply to the atomizing devices.

In another and highly simplified form of the invention, a single inventory tank or vessel is provided, which is calculated to retain an appropriate volume of coating material to complete a single unit, for example (or a predetermined number of units, if desired). During the inverval between units, as they are carried along by means of a continuous conveyor system, the high voltage electrostatic charging system is momentarily disabled, while the inventory tank is connected to the main supply system and replenished with a predetermined volume of material. As soon as the replenishment operation has been completed, the inventory tank is again isolated from the main supply system and the high voltage charging system is reenergized.

In any of its basic forms, the system of the invention advantageously utilizes air or fluid pressure to effect the transfer of the coating material from the transfer vessel to the inventory vessel and for the control of the levels of coating material within the vessel. Control systems provided for this purpose are simple and highly reliable for the service conditions under which the system is typically operated.

For a more complete understanding of the above and other features and advantages of the invention, reference should be made to the following detailed description of a preferred embodiment and to the accompanying drawings.

DESCRIPTION OF PREFERRED EMBODIMENTS OF THE INVENTION

Figure 1:
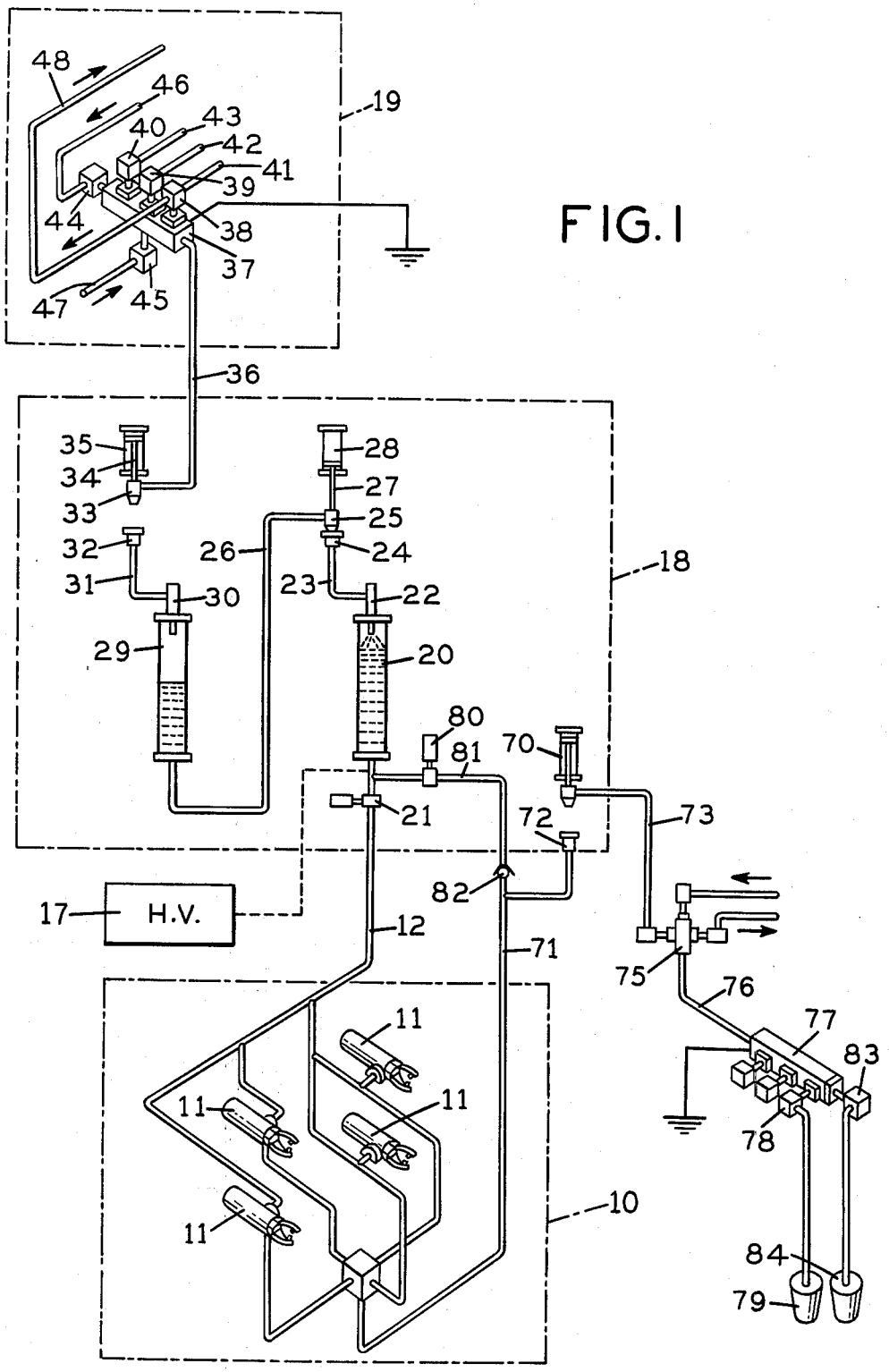
FIG. 1 is a simplified, schematic representation of an electrostatic paint spray system incorporating the voltage block system of the invention.
Figure 2:
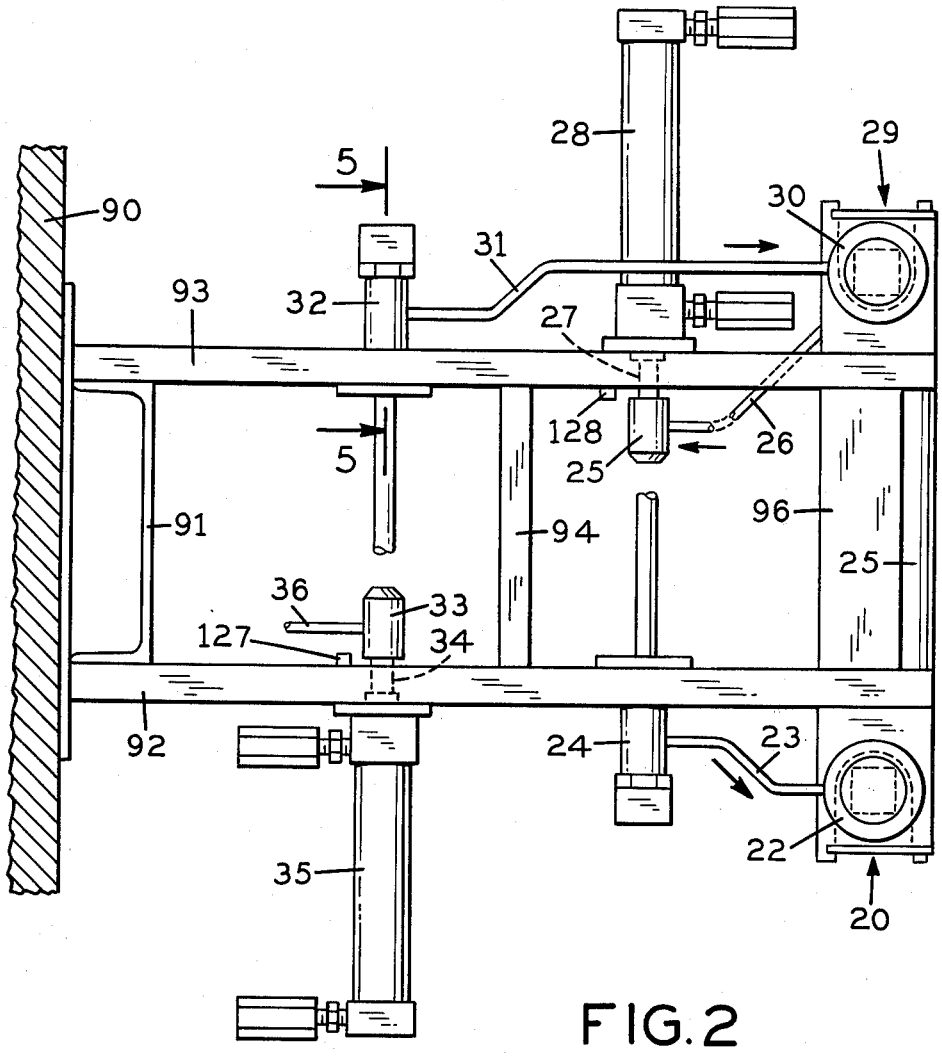
FIG. 2 is a top plan view of a coating material transfer apparatus according to the invention.

Referring now to the drawings, and initially to FIGS. 1–7 thereof, the reference numeral 10 designates in a general way a paint spray apparatus, which is typically in the form of a vertically reciprocating carriage mounting one or more atomizing spray guns 11. The details of the reciprocator and spray guns are well known to the trade and not important to the present invention. Each of the spray guns 11 is, in the form of the invention illustrated in FIG. 1, supplied with coating material through a supply line 12. As more particularly shown in FIG. 7, the supply line 12 leads into manifold lines 13, 14 leading to separate reciprocator stations 10, 10*a*. The respective manifold lines 13, 14 are connected through pressure regulator valves 15 to individual paint delivery lines 16, leading to individual atomizing spray guns 11. The paint pressure regulator 15 advantageously may be of the remote controlled type, as described and claimed in the Edward O. Norris U.S. Pat. No. 3,219,276, which is hereby incorporated by reference. Typically, the atomizing spray guns 11 are of the air atomizing type such as, for example, reflected in the Edward O. Norris U.S. Pat. No. 3,344,992, which is hereby incorporated by reference.

A source of high voltage, designated schematically by the reference numeral 17 in FIG. 1, is suitably connected into the system, so as to impress a high voltage charge at or near the nozzle area of the atomizing guns 11, whereby the atomized coating fluid discharged therefrom is comprised of finely divided, highly charged particles of the coating material. Typically, for commercial electrostatic paint spray installations, voltages on the order of 125,000 volts are commonly employed.

In the system of the invention, the reference numeral 18 in FIG. 1 designates in a general way a voltage block paint supply system, which serves to furnish the reciprocator 10 with a continuous supply of coating material from a primary paint supply system designated generally by the reference numeral 19, while remaining electrically isolated therefrom. The voltage block transfer system includes a paint vessel 20, referred to herein as an inventory tank, the discharge end of which is connected through a control valve 21 with the paint delivery line 12. The inventory tank 20 advantageously is in the form of an elongated vertical cylinder, with walls 21 of glass or transparent plastic, so that conditions within the vessel may be observed by the operator of the equipment. At the upper end of the vessel, there is a controllable inlet valve 22 which is connected through a conduit 23 with a controllable transfer valve 24.

Associated with the transfer valve 24 is a piston-mounted transfer coupling 25, by means of which a transfer line 26 may be coupled with the inlet of the transfer valve 24. The coupling device 25 is movably carried by the piston element 27 of a coupling actuator 28, whereby the coupling element 25 may be coupled with or disengaged from the transfer valve 24 in accordance with the principles of the invention to be described.

The transfer line 26 is in communication with the outlet of a transfer vessel 29 which, like the inventory tank 20, may be in the form of a vertically elongated, glass-walled vessel, enabling the equipment operator to visually observe conditions within the vessel. At the upper end of the transfer tank 29, there is a controllable delivery valve 30, which is connected through a fluid line 31 with a controllable transfer valve 32. The transfer valve 32 is associated with a piston-mounted coupling element 33, movably carried by the piston 34 of a coupling actuator 35. The coupling element 33 is connected through a supply line 36 with the outlet of a manifold block 37 forming part of a multiple color, recirculating paint selection system. In general, the paint selection system may be of the type shown in, for example, the Richard F. Wiggins U.S. Pat. No. 3,572,366, the disclosure of which is hereby incorporated by reference. The manifold 37 may mount a plurality of valves 38, 39, 40, each connected with a paint supply line 41–43 of a selected color. Additional valves 44, 45 connect solvent and air inlet lines 46, 47 respectively such that, by appropriate manipulation of the valves, paint of any one of several colors may be introduced into the supply line 36, or solvent and/or air may be introduced for cleanout in preparation for changing of color. Desirably, the paint supply lines 41–43 are of a continuously recirculating type. In the illustration of FIG. 1, the paint supply line 41 is connected to a return recirculating line 48, it being understood that the corresponding paint supply lines 42, 43 will be connected to similar recirculating return lines (not shown) such that the supply paint is always in circulation, even though not in use. Even the selected supply line (e.g., 41) that is at any time in use, desirably will have a continuous recirculating flow such that the paint is kept in motion during intervals when it is not being fed into the discharge system.

Figure 7:
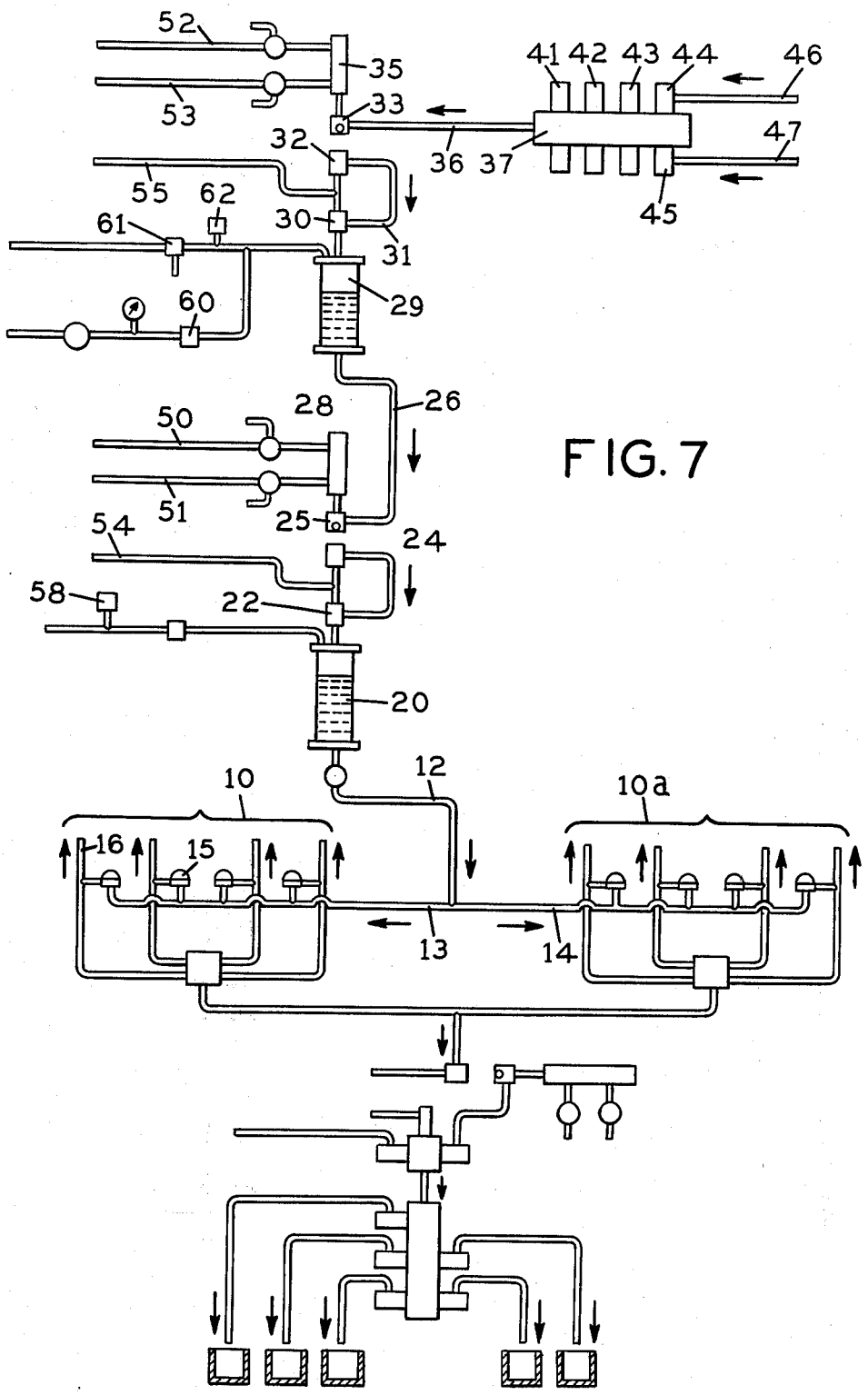
FIG. 7 is a highly simplified, schematic illustration of the control system utilized in connection with the voltage block system of FIG. 1.

With reference particularly to FIGS. 1 and 7, startup of the system is initiated by precharging of the lines with a paint of selected color, with the charging voltage off until, in the starting condition, the various spray guns are fully charged with the new paint, and the inventory vessel 20 is filled to a predetermined level and pressurized at a predetermined pressure level, for example, 40 psi. The transfer vessel 29 likewise is filled and maintained at a corresponding pressure of 40 psi. At this condition of the equipment, the coupling 25 may be engaged with the transfer valve 24 by extension of the coupling actuator 28, but the inventory tank 20 is closed to the transfer tank 29 by the closed delivery valve 22 at the top of the inventory tank.

In a typical paint spray operation, the paint pressure regulators 15 asscoated with the individual spray guns are set for operation at a pressure well below the minimum operating pressure of the inventory tank 20. For example, where the operating pressure of the painting regulators is 4–6 psi, the minimum pressure desired at the inventory tank may be 20 psi, so that under all conditions the pressure of the paint within the inventory vessel 20 is sufficient to maintain a continuous supply at the reciprocating spray guns 11.

In accordance with the invention, the filling of the inventory vessel 20 is brought about by discharging the coating fluid through the delivery valve 22 at a predetermined pressure, above that to be developed within the inventory vessel. For example, the fluid may be delivered at 50 psi, where it is desired to have a maximum of 40 psi in the inventory vessel. When the inventory vessel is empty, the pressure therein is low. Then, as paint is discharged into the vessel, which otherwise remains sealed, the air in the upper portion of the vessel is continuously compressed and reduced in volume, progressively increasing the internal pressure of the inventory vessel. When a desired pressure of 40 psi (e.g.) is detected by a pressure switch 58 (FIG. 7), the delivery valve 22 is closed, and the system prepares for a refilling of the transfer vessel 29 during the subsequent time interval in which paint is being utilized from the inventory vessel 20.

Prior to refilling of the transfer tank, the coupling actuator 28 is retracted, so that the inventory tank is physically and electrically isolated from the transfer tank. The related coupling actuator 35 is extended, in order to couple the transfer tank 29 with the main paint supply system 19. The transfer vessel 29 is at this stage pressurized at a predetermined, relatively lower pressure, for example, 20 psi, by closing off a valve 60 (FIG. 7) and actuating a valve 61 to exhaust the vessel 29 to the desired lower pressure level, as detected by a pressure switch 62. The transfer valve 32 and tank valve 30 are now open, while both of the air valves 60, 61 are closed. Paint of the selected color flows from the manifold 37, through the supply line 36, through a connecting line 31 and into the transfer tank. The pressure of the main paint supply is somewhat in excess of the desired maximum filling pressure in the transfer tank 29, which in this case is 40 psi.

As paint is discharged into the transfer vessel 29, the pressure of the diminishing volume of air in the top of the vessel is progressively increased. When a desired pressure level of 40 psi is reached, the transfer valve 32 and tank valve 30 are closed. The respective coupling actuators 28, 35 are then energized, the actuator 35 to retract, isolating the voltage block transfer system from the main paint supply 19 and mechanically coupling the transfer vessel 29 to the inventory vessel 20 in readiness for a replenishing operation.

As the paint is used up from the inventory tank 20, and the pressure therein reaches a predetermined minimum limit (.e.g, 20 psi) the pressure switch 58 is actuated to allow paint to transfer from the transfer vessel into the inventory vessel. Simultaneously, the valve 61, which is a three way solenoid valve, is actuated to admit air pressure at 50 psi into the top of the transfer vessel 29, to maintain a positive pressure differential as the liquid is exhausted from the transfer vessel and discharged into the inventory vessel to a pressure of 40 psi therein.

As will be appreciated, the transfer and replenishment cycle continues repetitively as long as there is a continued utilization of the paint by the spray devices 11. The continuity of the supply to the spray devices is maintained at all times, even during the periods in which the inventory tank 20 is being replenished, because the pressure within the inventory tank at all times remains at least slightly above the regulated pressure of the material delivered to the spray guns in any position of the gun throughout their stroke of vertical reciprocation. In each instance, the coupling acuators 28, 35 are controlled so as to maintain the primary paint supply 19 isolated from the high voltage charging system 17 through a sequence of break-before-make coupling and decoupling of the transfer valves 24, 32.

For effecting color change, the high voltage charging is disabled, and both of the coupling actuators 28, 35 are extended. In addition, a third coupling actuator 70 is extended, coupling a discharge line 71 through a transfer valve 72 to a paint outlet line 73. The discharge line 71 is connected through a multiple inlet control valve 74, which when opened enables liquid material flowing to the spray devices to circulate on past the devices, through the valve 74 and into the discharge line 71 for cleanout of the system without requiring the material to be just discharged through the spray guns. The outlet network includes a trap valve 75 leading through a common discharge line 76 to a discharge manifold 77. This system may be in accordance with the teachings of the Richard F. Wiggins U.S. Pat. No. 3,939,855, which is hereby incorporated by reference. It enables the unused residual of a selected color of paint in the system prior to a color change to be discharged through a selected color valve 78 into a selected paint receptacle 79 for reuse.

In a typical color change cycle, the old paint is purged through the system by air, which enters the system through the air inlet valve 45 at the main supply manifold 37. Initially, a shunt valve 80 is temporarily opened, while the multiple inlet valve 74 remains temporarily closed. This permits most of the residual coating material, including that in the transfer and inventory tanks 29, 20, to be discharged through a shunt line 81 and check valve 82 directly out to the dump manifold 77. After this part of the system is clear of the old paint, the shunt valve 80 is closed and the multiple inlet valve 74 is open, causing the balance of the paint to be discharged through the multiple inlet valve. A similar cycle follows, utilizing cleaning solvent, entering the system through the valve 44 at the main supply manifold 37. During the solvent flush, the paint discharge valve 78 is closed, and a solvent discharge valve 83 at the dump manifold opens, to receive the flushing solvent and the residual cleaned out paint. During this cycle, the spray heads 11 are open momentarily, to permit discharge of the small quantity of residual old paint and a small quantity of cleaning solvent as well. A further air purge cycle immediately follows, whereby the used solvent is driven through the system and discharged into its collecting receptacle 84. At the end of this cycle, the actuator 70 is retracted, and a new paint color valve at the supply manifold 37 is opened, enabling the system to be recharged with paint of a new color.

Referring now to FIGS. 2–6 of the drawing, the voltage block transfer apparatus, which is represented by the reference numeral 18 in FIG. 1, may advantageously be mounted on a frame structure adjacent to the associated vertically reciprocating paint spray apparatus. In a typical case, the frame structure may comprise a mounting support 90 (FIG. 2) to which is secured a vertically extending section of channel frame 91. A pair of widely spaced heavy mounting plates 92, 93 extend horizontally outward in cantilever fashion from the channel beam 91, being rigidly secured thereto. The mounting plates 92, 93 are formed of an insulating material, such as an appropriate structural plastic, which will enable working voltages (e.g., 125,000 volts) to be isolated from the structural support 90, as will appear. A pair of cross braces 94, 95 extends between the mounting plates 92, 93, and a horizontal tank mounting bracket 96 is carried at the outer extremity of the plates 92, 93. The cross members 94, 95, as well as the tank mounting bracket 96, are all formed of insulating material.

At the opposite ends of the tank mounting bracket 96, the respective inventory tank 20 and transfer tank 29 are suspended, being maintained in electrical isolation from each other by the intervening insulated structure. At the top of each of the tanks, there is a delivery valve 22, 30, of a type shown in FIG. 6 and to be described in more detail.

Secured to the mounting plate 92 is the body of the coupling actuator 35, the piston rod 34 of which extends through the mounting plate and secures the coupling element 33 which carries with it a flexible fluid inlet line 36.

Directly opposite and coaxial with the actuator 35 is the transfer valve 32 (see FIG. 5) which is mounted in the opposite dielectric mount plate 93, in widely spaced and insulated relation to the coupling element 33, when the latter is in its retracted position. The transfer valve 32 connects through the fluid line 31 to the inlet of the delivery valve 30, leading to the transfer tank 29.

Mounted on the dielectric plate 93, opposite from the coupling actuator 35, is the second coupling actuator 28. The piston rod 27 of the actuator extends through the plate and mounts the movable coupling element 25, the latter being connected through a flexible fluid line 26 to the lower end of the transfer vessel 29. The related transfer valve 24 is mounted directly opposite to and coaxial with the actuator 28, on the opposite insulated mounting plate 92. The transfer valve 24 connects through a connecting line 23 with the delivery valve 22 at the top of the inventory tank 20.

Figure 4:
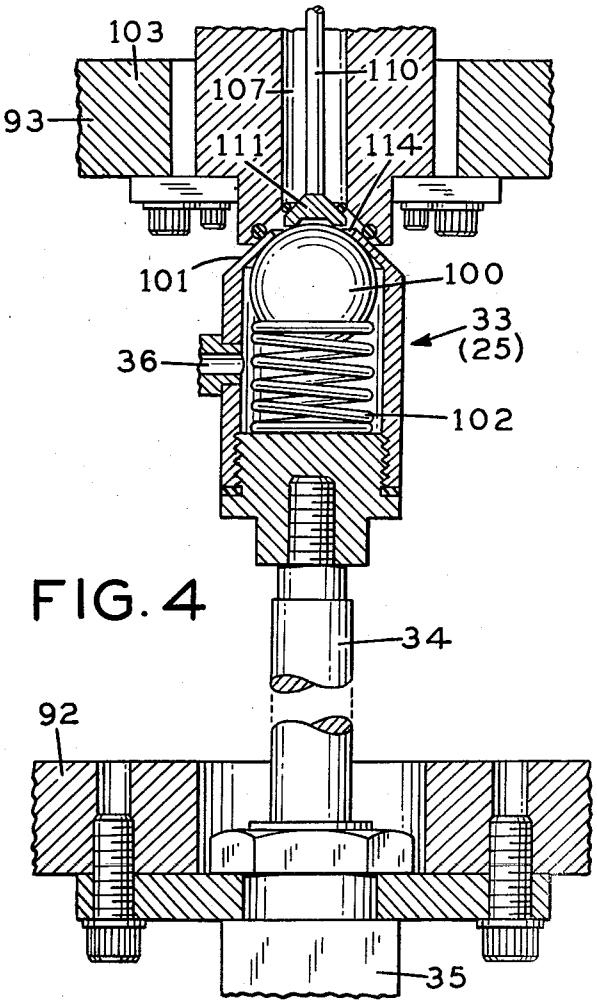
FIG. 4 is an enlarged, fragmentary view illustrating a transfer valve arrangement utilized in the system of the invention.
Figure 3:
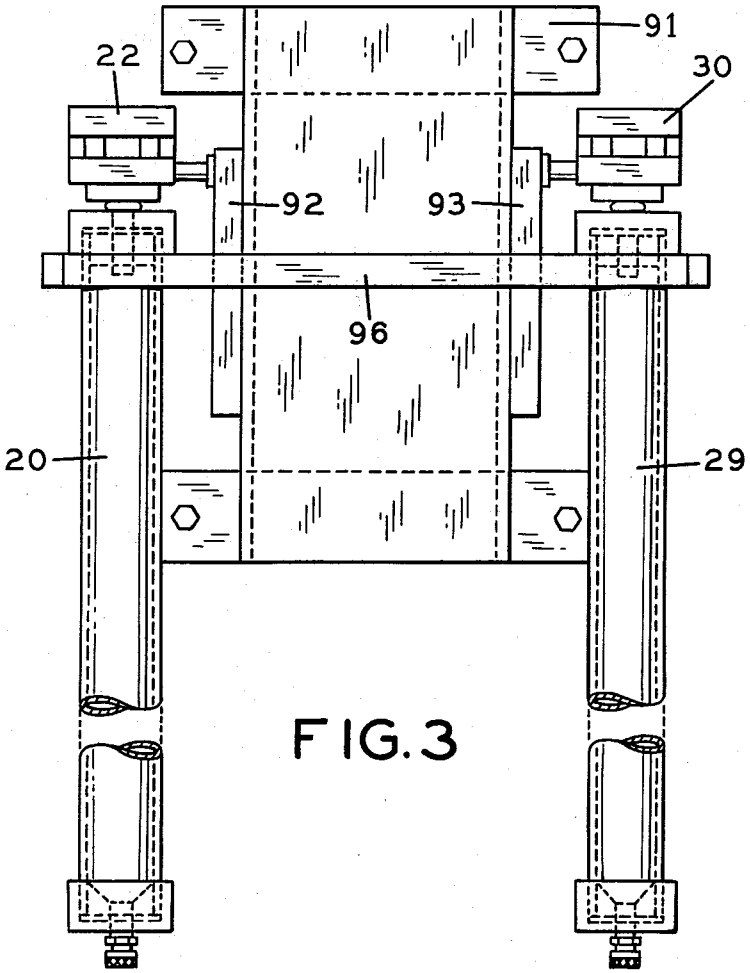
FIG. 3 is a front elevational view of the apparatus of FIG. 2.
Figure 5:
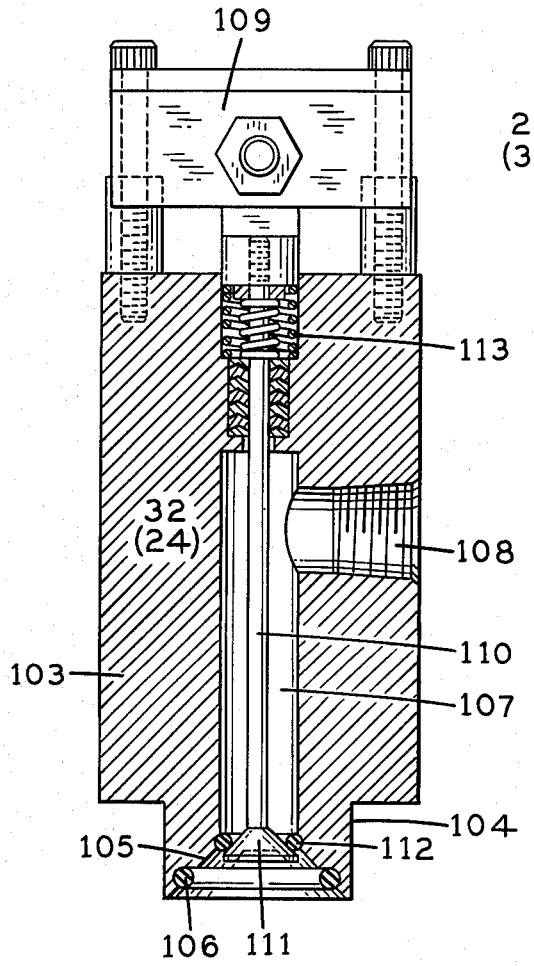
FIGS. 5 and 6 are cross sectional views illustrating typical forms of paint valves utilized in the system of the invention.

As reflected in FIG. 4, the coupling elements 33, 25, are internally valved by means of a check ball 100 seating against the internal surfaces of frustoconical end wall 101 under the urging of a compressed coil spring 102. The associated transfer valve, shown in more detail in FIG. 5, includes a main valve body 103 mounted rigidly on the dielectric mounting plates and having an inlet portion 104 extending through the mounting plate into a position engageable by the frustoconical end portion 101 of the coupling element. The inlet end of the transfer valve is conically recessed at 105, complementary to the end portion of the coupling element, and is provided with an O-ring sealing element 106 engageable with the exterior of the frustoconical surface of the coupling element, as reflected in FIG. 4, when the coupling element is advanced to its extended position by its associated actuator.

The body 103 of the transfer valve is provided with a valved central passage 107 leading to an outlet port 108. A small pneumatic actuator 109 is attached to the outer end of the valve body 103 and is coupled with a valve stem 110 which extends into the valve body, through the passage 108 and to the inlet end of the valve. At its extremity, the valve rod 110 is provided with a conical valve head 111 arranged to seat against a second O-ring sealing element 112 provided in the conical inlet recess to the transfer valve. The valve stem is normally urged by a spring 113 to a closed position, but is displaceable longitudinally to an open position (downwardly as viewed in FIG. 5) by the actuator 109.

As reflected in FIG. 4, the frustoconical end portion 101 of the coupling element 33 is provided with an outlet opening 114, which is slightly greater than the diameter of the valve head 111. The geometrical arrangement of the parts is such that, when the coupling element 33 is first brought into sealing contact with the conical inlet recess 105, the valve head 11 is in directly confronting relation with, but spaced at least slightly from the check ball 100 within the coupling element. However, when the elements are in coupled relation, as shown in FIG. 4, subsequent actuation of the fluid actuator 109, to open the transfer valve 32, causes the check ball 100 to be depressed against the resistance of its retaining spring 102, enabling the fluid to flow through the coupling element and into the valve of the passage 107. The transfer valve is in every case closed prior to retraction of the coupling element 33, so that both valved elements are closed prior to decoupling.

Figure 6:
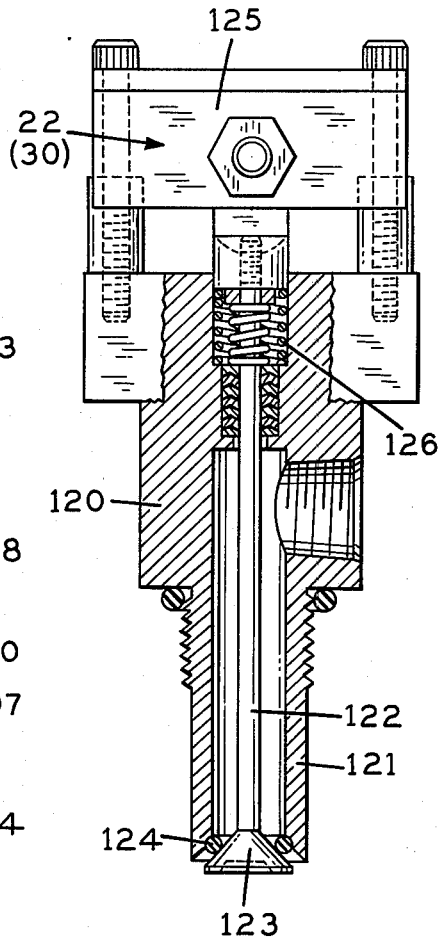

FIG. 6 illustrates a desirable form of delivery valve 22, 30. A valve body 120 having an elongated neck 121 is arranged to be received in and threadedly engaged with the upper end tap portions of the transfer and inventory vessels 29, 20. An elongated valve stem 122 extends through the valve body and mounts a conical valve head 123 for cooperation with an O-ring valve seat 124. At the upper end of the valve stem there is a small fluid actuator 125 similar to the actuator 109 for the transfer valve. The valve stem 122 is maintained normally closed by the spring 126, but the valve is openable by the actuator 125 at desired times. As will be evident in FIGS. 5 and 6, many of the components of the transfer and delivery valves may be common.

Desirably, the control system of the present invention includes safety interlocks, assuring that the respective coupling actuators 28, 35 are not simultaneously extended, unless the high voltage is disabled. To this end, each of the coupling actuators is provided with a position sensor (not shown) which, in normal operation with the high voltage supply in operation, permits one coupling actuator to advance only after the other coupling actuator has been fully retracted and is sensed in its retracted position. Proximity switch devices 127, 128 (FIG. 2) may advantageously be used for this purpose, serving to detect the presence or absence of the respective coupling element 33, 25 in its fully retracted position.

The system of FIGS. 1–7 provides a simplified, reliable and uniquely advantageous system for the continuous supply to electrostatically charged spray guns of a conductive spray material. The system is fully compatible with the desire of users of automatic painting system to provide for a constantly recirculating supply of a variety of different colored, selectively useable paints, while maintaining the recirculating supply system entirely isolated from the high voltage system. While other systems and techniques are known and available for isolating the charged spray equipment from the remote paint supply, the system of the invention is particularly advantageous in that it is fast, positive, utilizes simple, reliable components, and is easily adaptable to color change system without introducing problems in the cleanout and color change cycle. The voltage block and transfer system is further advantageous, in that it may be readily incorporated into existing, multicolor automatic painting lines initially designed for use exclusively with nonconductive coating materials. In this respect, the voltage block and transfer arrangement, as reflected in the block area 18 in FIG. 1, may be bodily substituted in an otherwise conventional, preexisting system with very little difficulty and expense.

Figure 8:
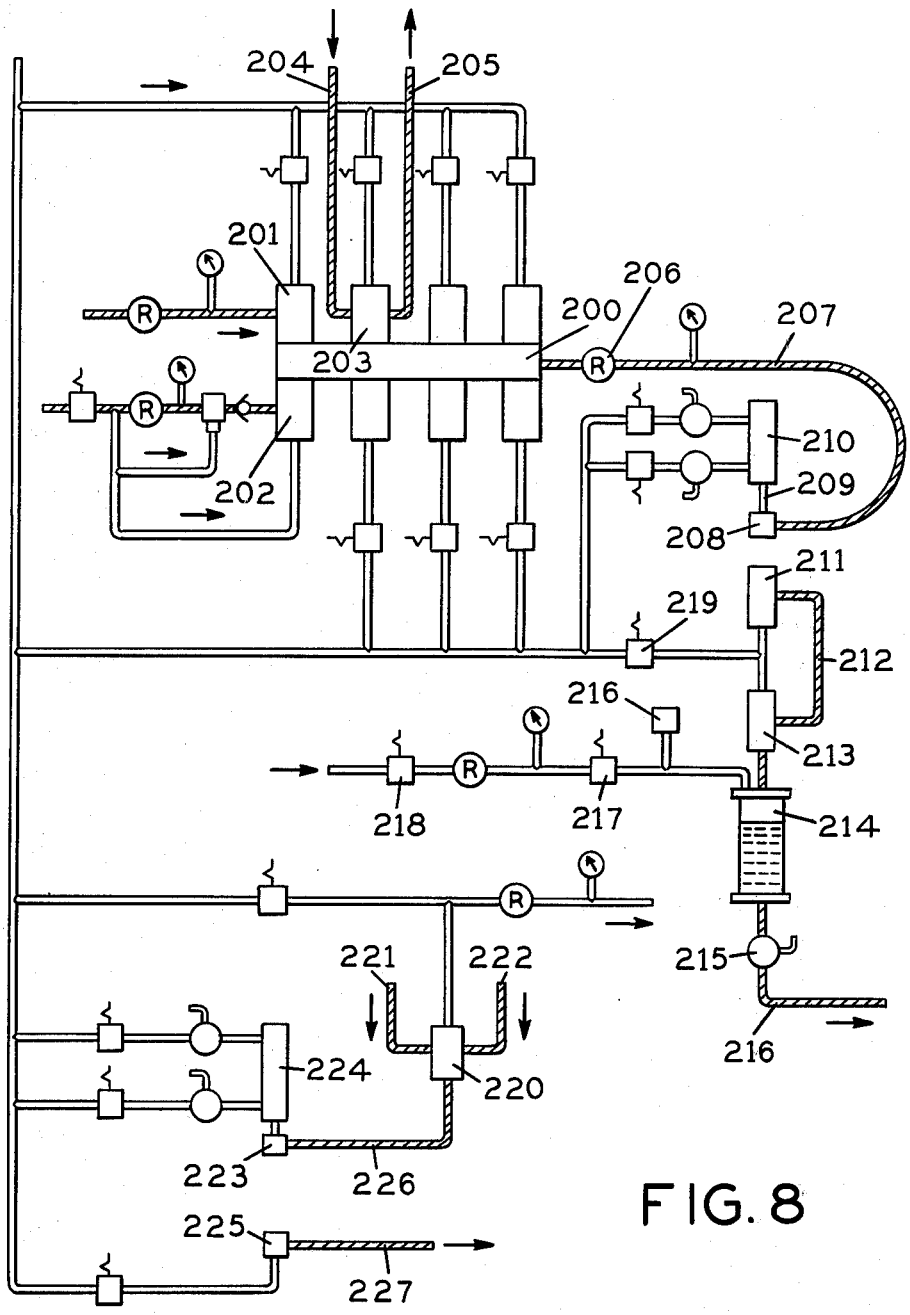
FIG. 8 is a schematic illustration of an alternative form of the voltage block system, utilizing a single tank.

In the modification of FIG. 8, a somewhat simplified version of the system is illustrated, which is designed particularly for unit coating operations, in that a given quantity of coating material, measured to be precisely enough to coat a single object moving along the conveyor line, is provided in the inventory tank. In the short interval between units spaced along the constantly moving conveyor, the system is replenished and, if appropriate, a color change is effected. The system is adapted to enable a complete color change between each of successive units to be painted, so that successive units may be painted with different colors according to a random schedule, as production requirements dictate. In the schematic illustration of FIG. 8, lines provided for the flow of coating material are indicated with hatched double lines, whereas all other lines are for control fluids. A color selection manifold of known type is provided with a solvent inlet valve 201, an air inlet valve 202 and a variety of individual paint inlet valves 203, one for each color desired in the color selection pattern. A single identified valve 203 is shown to be connected into a recirculating tank system including recirculating lines 204, 205, it being understood that each of the individual color selection valves will be connected to an independent recirculating system for its particular paint. The outlet of the color selection manifold connects through a pressure regulator 206 with a supply line 207, leading to a coupling element 208, which may be of the type shown in FIG. 4. The coupling element 208 is mounted movably upon the piston rod 209 of a coupling actuator 210 mounted remotely from, but coaxial with a transfer valve 211, which may be of the type shown in FIG. 5. The transfer valve is connected through a connecting line 212 to a delivery valve 213, mounted on at the top of an inventory vessel 214. The delivery valve 213 may be of the type shown in FIG. 6 of the drawings. The lower portion of the inventory vessel 214 leads through a shut off valve 215 to an outlet line 216 connected through an appropriate pressure regulator means to electrostatically charged spray devices, which may be basically the same as those described in connection with the embodiments of FIGS. 1–7.

As will be understood, the retractable coupling element 208 and the transfer valve 211 are separately mounted on insulating structure, so as to be electrically isolated when the coupling element is retracted.

In normal operation, after the painting of a given unit of work, the upper portion of the inventory vessel 214 is vented to atmosphere, by operation of a three way solenoid valve 217. A two way valve 218, located upstream, is at this time closed.

With the high voltage turned off, during the brief non-painting interval, the coupling 208 is advanced by the coupling actuator 210 and connected with the transfer valve 211. The transfer valve 211 as well as the delivery valve 213 are opened by actuation of a solenoid valve 219 to activate the air actuators associated with the respective valves.

Assuming that the next successive unit is to be painted with the same color, refilling of the inventory vessel is commenced upon opening of the transfer and delivery valves, after engagement of the coupling element 208. Paint being discharged into the vessel 214 compresses the air trapped in the upper portion thereof, the valves 217, 218 having been closed at this stage. When the air pressure above the liquid material and the vessel reaches a predetermined level, e.g., 40 psi, a pressure switch 219 is actuated to signify the filled condition. The valves 211, 213 are thereupon closed, the coupling element 208 is removed to its fully retracted position, and the high voltage charging potential is restored to permit resumption of painting as the next work unit approaches the painting station. It is understood, of course, that appropriate interlock means, such as already described in connection with the apparatus of FIGS. 1–7 will be employed to assure the physical retraction of the coupling element 208 prior to restoration of high voltage at the paint spray outlets.

In the event a color change is indicated, a color change sequence is followed, substantially as described in connection with the embodiment of FIGS. 1–7. In this connection, the reference numeral 220 indicates a multiple inlet control valve, the inlet lines 221, 222 thereto lead from respective spray devices. During the color change cycle, which is accomplished in the interval between successive work units, the high voltage charging potential is turned off. A retractable coupling valve 223 is advanced by its coupling actuator 224 to couple with a transfer valve 225. When the coupled transfer valve 225 is open, along with the multiple inlet control valve 220, paint of the old color may be forced through the control valve 20, and through discharge lines 226, 227 to a collection facility, which may be substantially as described with respect to the modification of FIGS. 1–7, in order to enable the unused but unsprayed paint to be collected and segregated for reuse.

The system of FIG. 8 lends itself well to painting lines for painting a succession of like units, where there is need for frequent color change, and where the paint consumption for a single unit is appropriate for unit filling of the inventory tank. The inventory tank is replenished after the painting of each unit, during the non-painting interval while the next unit is being conveyed into the working span of the painting system. Because no painting is going on during this short interval, the high voltage may be disabled while the system is coupled to the primary paint supply. During painting, the high voltage is isolated from the primary paint supply by retraction of the coupling actuator 210.

In either of its forms, the system of the present invention provides a simplified, highly reliable and advantageous arrangement for the utilization of conductive paints, in an electrostatic spray painting system, in conjunction with continuously recirculating primary paint supplies. The primary paint supply is coupled to the distribution system as frequently as necessary to maintain continuity of the paint at the spray guns. In the system of FIGS. 1–7, this is accomplished while the electrostatic spray painting operation is actually continuing, by the use of an intermediate transfer vessel, which, while coupled to the primary paint supply, is electrically isolated from the inventory tank which is supplying the spray guns. In the system of FIG. 8, where the interval between units to be painted is sufficient, the high voltage may be turned off, and the inventory tank coupled directly to the primary paint supply system for replenishment and/or color change during the interval between workpieces.

In either of its forms, the system of the present invention advantageously utilizes simple pressurized air delivery systems for effecting the desired movement of paint in the distribution system. A simplified control arrangement is provided, which includes means for sensing the increasing or decreasing pressure of a volume of air trapped in the upper portion of the inventory or transfer vessel, as the case may be. The paint is transferred from one vessel to another, or from the inventory vessel to the spray devices, through the action of the compressed volume of air. As pressure is gained or lost, during filling or discharge of the paint, the condition is sensed by simple, remotely located pressure switch devices, which enable refilling operations to be commenced and terminated at appropriate times. The system of the invention lends itself to a high degree of automation, being easily set up for operation with commercially available programmable control over equipment, for example.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A supply system for furnishing conductive coating materials to an electrostatic coating device, which comprises (a) a recirculating primary supply of liquid coating material, (b) a spray device for applying said coating material to a workpiece, (c) means for imparting a high voltage charge to said spray device, (d) a sealed coating material vessel communicating with said spray device, (e) means for periodically replenishing said vessel with coating material from said primary supply, (f) means for electrically isolating said vessel from said primary supply when said high voltage is applied to said spray device, (g) means for placing said sealed vessel under gas pressure to effect displacement of coating fluid to said spray device.

2. The supply system of claim 1, further characterized by (a) said means for replenishing said vessel comprising a second vessel, (b) means for connecting said second vessel alternatively to said first vessel or said primary supply.

3. The supply system of claim 1, further characterized by (a) said means for replenishing said vessel comprising a movable coupling element and valve for periodically placing said vessel in direct communication with said primary supply.

4. The supply system of claim 3, further characterized by (a) means for venting said vessel to ambient pressure after each unit painting cycle, (b) means for closing and sealing the vessel prior to replenishing with coating material, and (c) means for sensing the pressure level in said vessel and, in response thereto, controlling said replenishing operation.

5. The supply system of claim 2, further characterized by (a) a retractable coupling element associated with each of said vessels, (b) coupling actuators for controllably moving said coupling elements into coupled position in fluid communication with said vessels for filling the same, and (c) control sensing means for arranging retraction of one of said coupling elements prior to moving of the other into coupled position.

6. The supply system of claim 5, further characterized by (a) each of said coupling elements including a spring biased, normally closed check valve, (b) transfer means positioned in alignment with said check valves and operative to effect opening thereof when said coupling elements and transfer means are in coupled condition.

7. The supply system of claim 6, further characterized by (a) said transfer means including transfer valves having controllably movable valve plungers, (b) said plungers when moved in a valve opening direction, being engageable with said check valves to effect opening thereof.

8. A transfer system for supplying conductive coating material continuously to an electrostatically charged spray device from a primary supply, which comprises, (a) a closed transfer vessel, (b) a closed inventory vessel, (c) means connecting said inventory vessel to said spray device for supplying coating material thereto, (d) first disengageable means for connecting said transfer vessel to said inventory vessel for effecting transfer of coating material to said inventory vessel, (e) second disengageable means for connecting said primary supply to said transfer vessel for supplying coating material to said transfer vessel, and (f) said disengageable connecting means being alternatively connectable with the respective vessels whereby only one of said connecting means can be connected at any time during operation of the electrostatic charged spray device.

9. A transfer system according to claim 8, further characterized by (a) first air pressure sensing means associated with said inventory vessel and operative to commence transfer of coating material to said inventory vessel when air pressure in said vessel reaches a predetermined low level and to terminate such transfer when said pressure reaches a predetermined maximum, (b) said minimum pressure being in excess of the pressure required for desired operation of said spray device.

10. A transfer system according to claim 9, further characterized by (a) first air pressure control means operative during transfer of coating material to said inventory tank to maintain air pressure in said transfer tank at a predetermined level above the predetermined maximum pressure in said inventory tank.

11. A transfer system according to claim 10, further characterized by (a) second air pressure control means for venting said transfer vessel to a predetermined low pressure prior to replenishing of said transfer vessel from said primary supply, and (b) second air pressure receiving means for terminating the replenishing of said transfer tank when the air pressure therein rises to a predetermined higher pressure.

* * * * *

US004313475B1

REEXAMINATION CERTIFICATE (2333rd)

United States Patent [19]

Wiggins

[11] B1 4,313,475

[45] Certificate Issued Jul. 12, 1994

[54] VOLTAGE BLOCK SYSTEM FOR ELECTROSTATIC COATING WITH CONDUCTIVE MATERIALS

[75] Inventor: Richard F. Wiggins, Fairfield, Conn.

[73] Assignee: Nordson Corporation, Westlake, Ohio

Reexamination Request:
No. 90/003,137, Jul. 23, 1993

Reexamination Certificate for:

| | |
|---|---|
| Patent No.: | **4,313,475** |
| Issued: | **Feb. 2, 1982** |
| Appl. No.: | **163,158** |
| Filed: | **Jun. 26, 1980** |

[51] Int. Cl.[5] ..... B65B 3/04

[52] U.S. Cl. ..... 141/18; 141/21; 141/192; 239/690; 239/691; 118/629; 118/506

[58] Field of Search ..... 141/2, 18, 21, 192; 222/56, 190; 118/621, 627, 629; 239/3, 690, 691, 694

[56] References Cited

U.S. PATENT DOCUMENTS

| | | | |
|---|---|---|---|
| 3,892,357 | 7/1975 | Tamny | 239/706 |
| 3,933,285 | 1/1976 | Wiggins | 222/56 |
| 3,934,055 | 1/1976 | Tamny | 427/8 |
| 4,017,029 | 4/1977 | Walberg | 239/695 |
| 4,020,866 | 5/1977 | Wiggins | 137/592 |
| 4,275,834 | 6/1981 | Spanjersberg et al. | 239/3 |

*Primary Examiner*—J. Casimer Jacyna

[57] ABSTRACT

The disclosure relates to a voltage block system for delivering conductive coating materials continuously to electrically charged electrostatic paint spray devices from a primary paint supply system which is at ground potential. In a preferred form, the system utilizes cooperatively associated coating material transfer and inventory vessels. The inventory vessel is connected to the electrostatically charged spray devices and continuously supplies coating material thereto. The transfer vessel is alternatively coupled to the primary paint supply, in order to be replenished thereby, and with the inventory tank, in order to refill the inventory tank prior to its exhaustion. The inventory tank is maintained under a positive gas pressure both during refilling operations and at other times, so that coating material is always supplied to the spray devices under pressure. At all times, the primary paint supply is isolated from the high voltage. In a simplified, special purpose version, a single inventory tank is refilled during intervals between the arrival of successive workpieces on a continuously moving conveyor. In this version, the high voltage is turned off during refilling operations. The system lends itself well to production lines, where there is frequent need for changing from one color of coating material to another.

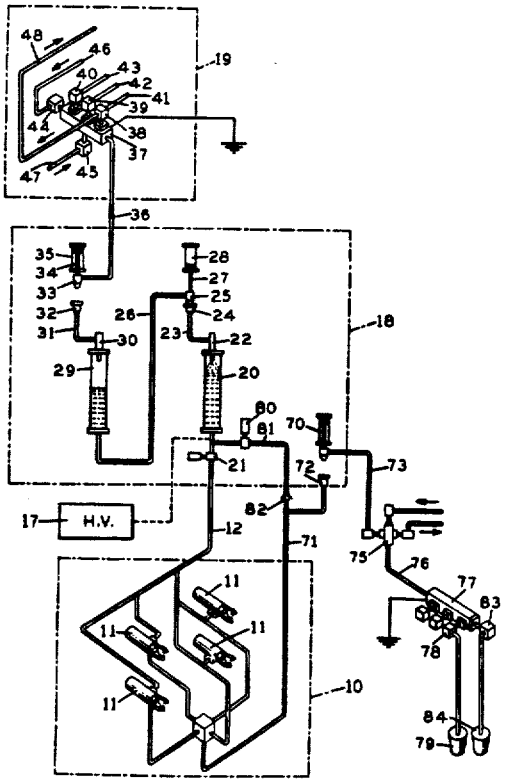

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claims 1, 2, 4 and 8 are determined to be patentable as amended.

Claims 5–7 and 9–11, dependent on an amended claim, are determined to be patentable.

1. A supply system for furnishing conductive coating materials to an electrostatic coating device, which comprises (a) a recirculating primary supply of liquid coating material, (b) a spray device for applying said coating material to a workpiece, (c) means for imparting a high voltage charge to said spray device, (d) a sealed coating material vessel communicating with said spray device, (e) means for periodically replenishing said vessel with coating material from said primary supply, (f) means for electrically isolating said vessel from said primary supply when said high voltage is applied to said spray device, *said isolating means including first and second coupling elements at least one of which is movable with respect to the other between a position wherein said first and second coupling elements are mechanically coupled to form a substantially closed flow path for the transfer of coating material from said primary supply into said vessel, and a position wherein said first and second coupling elements are uncoupled to electrically isolate said vessel from said primary supply when said high voltage is applied to said spray device, and*

(g) means for placing said sealed vessel under gas pressure to effect displacement of coating fluid to said spray device.

2. The supply system of claim 1, further characterized by (a) said means for replenishing said vessel comprising a second vessel, (b) means *including a movable coupling element* for connecting said second vessel alternatively to said first vessel or said primary supply.

4. The supply system of claim [3] *1*, further characterized by (a) means for venting said vessel to ambient pressure after each unit painting cycle, (b) means for closing and sealing the vessel prior to replenishing with coating material, and (c) means for sensing the pressure level in said vessel and, in response thereto, controlling said replenishing operation.

8. A transfer system for supplying conductive coating material continuously to an electrostatically charged spray device from a primary supply, which comprises, (a) a closed transfer vessel, (b) a closed inventory vessel, (c) means connecting said inventory vessel to said spray device for supplying coating material thereto, (d) first [disengageable] *transfer* means for connecting said transfer vessel to said inventory vessel [for] *and* effecting transfer of coating material *from said transfer vessel* to said inventory vessel, *said first transfer means including a first coupling element communicating with said transfer vessel and a second coupling element communicating with said inventory vessel,*

(e) second [disengageable] *transfer* means for connecting said primary supply to said transfer vessel [for] *and* supplying coating material *from said primary supply* to said transfer vessel, [and] *said second transfer means including a third coupling element communicating with said primary supply and a fourth coupling element communicating with said transfer vessel,*

(f) [said disengageable connecting means being alternatively connectable with the respective vessels whereby only one of said connecting means can be connected at any time ] *said third and fourth coupling elements of said second transfer means being engageable to permit the transfer of coating material from said primary supply to said transfer vessel while said first and second coupling elements of said first transfer means are disengaged, said first and second coupling elements of said first transfer means being engageable to permit the transfer of coating material from said transfer vessel to said inventory vessel while said third and fourth coupling elements of said second transfer means are disengaged, only one of said first and second transfer means having coupling elements which are engaged during operation of the electrostatic charged spray device.*

* * * * *